US007408564B2

(12) United States Patent
Park

(10) Patent No.: US 7,408,564 B2
(45) Date of Patent: Aug. 5, 2008

(54) APPARATUS AND METHOD FOR SETTING PRINT CONDITION ACCORDING TO THERMAL PRINTHEAD

(75) Inventor: Sang-hyun Park, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 254 days.

(21) Appl. No.: 11/283,733

(22) Filed: Nov. 22, 2005

(65) Prior Publication Data

US 2006/0109336 A1 May 25, 2006

(30) Foreign Application Priority Data

Nov. 22, 2004 (KR) ..... 10-2004-0095987

(51) Int. Cl.
*B41J 2/355* (2006.01)
*B41J 2/36* (2006.01)

(52) U.S. Cl. ..... 347/188

(58) Field of Classification Search ..... 347/188, 347/191; 400/120.09, 120.11
See application file for complete search history.

(56) References Cited

U.S. PATENT DOCUMENTS 6,116,710 A * 9/2000 Tajika et al. ..... 347/14
6,310,636 B1 * 10/2001 Tajika et al. ..... 347/14
6,457,794 B1 * 10/2002 Tajika et al. ..... 347/11
6,478,399 B1 * 11/2002 Mitsuzawa et al. ..... 347/19
6,584,290 B2 * 6/2003 Kurz et al. ..... 399/12
6,837,564 B2 * 1/2005 Akama et al. ..... 347/19
7,123,367 B1 * 10/2006 Kanaya et al. ..... 358/1.13

FOREIGN PATENT DOCUMENTS

| | | |
|---|---|---|
| JP | 2001-310506 | 11/2001 |
| JP | 2002-137430 | 5/2002 |
| JP | 2002-304279 | 10/2002 |
| JP | 2004-058554 | 2/2004 |
| JP | 2004-206553 | 7/2004 |
| JP | 2004-216690 | 8/2004 |

* cited by examiner

*Primary Examiner*—Huan H Tran
(74) *Attorney, Agent, or Firm*—Roylance, Abrams, Berdo & Goodman, L.L.P.

(57) ABSTRACT

An apparatus is provided for setting a print condition according to a TPH (thermal printhead) of a thermal image forming apparatus that includes a TPH ID (identifier) identification portion identifying TPH vendor information by decoding an ID of the TPH. A print condition storing portion stores a predetermined print condition corresponding to a TPH vendor. A print condition setting portion sets the print condition corresponding to a TPH vendor as a print condition corresponding to the identified TPH vendor information.

17 Claims, 4 Drawing Sheets

APPARATUS AND METHOD FOR SETTING PRINT CONDITION ACCORDING TO THERMAL PRINTHEAD

CROSS REFERENCE TO RELATED APPLICATION

This application claims the benefit under 35 U.S.C. § 119 (a) of Korean Patent Application No. 10-2004-0095987, filed on Nov. 22, 2004, in the Korean Intellectual Property Office, the entire disclosure of which is hereby incorporated by reference.

BACKGROUND OF THE INVENTION

1. Field of the Invention

The present invention relates to a thermal image forming apparatus using a thermal printhead (TPH). More particularly, the present invention relates to an apparatus and method for setting a print condition according to a TPH of the thermal image forming apparatus.

2. Description of the Related Art

Generally, a thermal image forming apparatus prints text or images using heat. The thermal image forming apparatus includes a method of using media capable of presenting a predetermined color in reaction to heat and a method of using an ink ribbon that transfers a predetermined color to a sheet of paper in reaction to heat. The thermal image forming apparatus is advantageous in that mechanical sound generated during printing is very small and a structure thereof is simple so that it can be made to be small in size. The method of using the ink ribbon requires an additional driving apparatus to drive the ink ribbon and the ink ribbon needs to be continuously replaced so that print costs per page is high. Alternatively, a method of using the media which does not need the ink ribbon uses thermal paper. Thus, since a predetermined color appears when heat is applied to the thermal paper, the print costs are relatively lower than the method of using the ink ribbon.

The TPH for printing text or images is a core part of the thermal image forming apparatus. The TPH is manufactured by depositing a plurality of electric heating bodies on a ceramic insulation body in a predetermined form of points. When current is applied to a wire connecting the points, the electric heating bodies generate heat so that the text or image can be printed on a thermal paper located close to the TPH.

However, the TPH used for the thermal image forming apparatus has different print conditions between various vendors, such as, for example, gamma, sensitivity, and other parameters, such as ampli, ki, alpha, and so forth. Thus, to set an optimal print condition, it is needed to appropriately set a print condition according to a particular TPH vendor. To this end, a user inconveniently needs to set the print condition according to the TPH vendor.

Accordingly, a need exists for a thermal image forming apparatus having an improved thermal printhead that automatically sets print conditions for each particular vendor.

SUMMARY OF THE INVENTION

The present invention provides an apparatus and method for setting a print condition according to a TPH that automatically sets print conditions suitable for a TPH of each vendor by identifying an ID of the TPH vendor.

According to an aspect of the present invention, an apparatus for setting a print condition according to a TPH (thermal printhead) of a thermal image forming apparatus includes a TPH ID (identifier) identification portion identifying TPH vendor information by decoding an ID of the TPH, a print condition storing portion storing a predetermined print condition corresponding to a TPH vendor, and a print condition setting portion setting the print condition corresponding to the TPH vendor as a print condition corresponding to the identified TPH vendor information.

The apparatus further includes a print condition search portion searching the print condition storing portion for a print condition corresponding to the TPH vendor identified by the TPH ID identification portion. The print condition setting portion sets a print condition searched by the print condition search portion as a print condition of the thermal image forming apparatus.

The apparatus further includes a display portion displaying a result of the search by the print condition search portion and, when a print condition with respect to the TPH vendor identified by the TPH ID identification portion does not exist, notifying such fact.

The print condition setting portion further includes a manual setting portion manually setting a print condition by changing a print condition displayed on the display portion.

The print condition storing portion is preferably in the form of a lookup table.

According to another aspect of the present invention, a method for setting a print condition according to a TPH (thermal printhead) of a thermal image forming apparatus includes identifying TPH vendor information by decoding an identifier (ID) of the TPH, and setting a print condition corresponding to an identified TPH vendor information as a print condition of the thermal image forming apparatus.

The TPH vendor information includes the TPH vendor information and TPH model information.

The TPH print condition includes at least one of gamma, sensitivity, and a predetermined parameter of Ampli, Alpha, and Ki.

The setting of a print condition corresponding to an identified TPH vendor information as a print condition of the thermal image forming apparatus includes searching the print condition storing portion. A predetermined print condition is stored according to the TPH vendor information for a print condition corresponding to the identified TPH vendor information. A searched print condition is set as a print condition of the thermal image forming apparatus.

In the setting of a searched print condition as a print condition of the thermal image forming apparatus, when the searched print condition exists, the searched print condition is displayed. When the searched print condition dose not exist, the message indicating that the print condition does not exist is displayed.

The displayed print condition is manually changed, if necessary.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
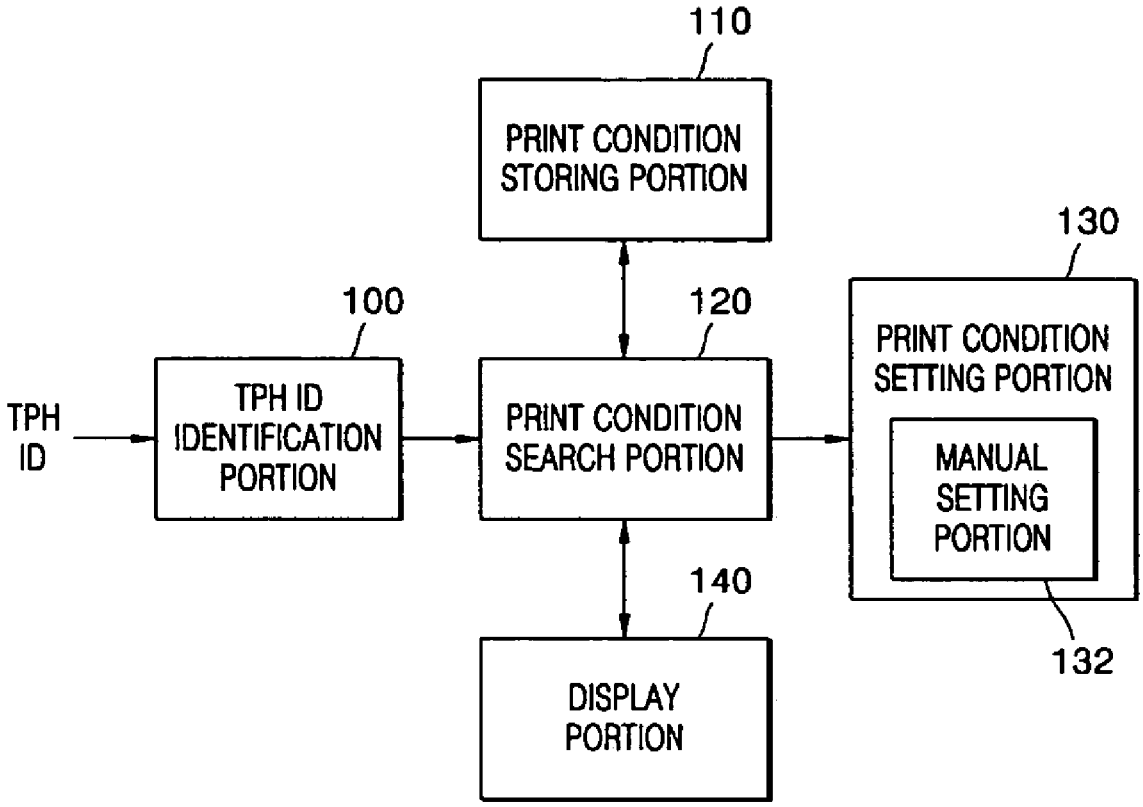
FIG. 1 is a block diagram illustrating a configuration of an apparatus for setting a print condition according to a TPH according to an exemplary embodiment of the present invention.

FIG. 1 is a block diagram illustrating a configuration of an apparatus for setting a print condition according to a TPH according to an exemplary embodiment of the present invention. Referring to FIG. 1, the apparatus includes a TPH ID identification portion 100, a print condition storing portion 10, a print condition search portion 120, a print condition setting portion 130, and a display portion 140.

The TPH ID identification portion 100 identifies TPH vendor information by decoding an identifier (ID) of the TPH. The TPH ID identification portion 100 may be implemented using a central processing unit (CPU, not shown). When a TPH ID is input through an input/output data port (IO port, not shown) of the CPU at a system initialization stage, the TPH ID is decoded so that the TPH vendor information may be obtained. The TPH vendor information may be information on a TPH manufacturer and a TPH model that the TPH manufacturer provides.

The print condition storing portion 110 stores a predetermined print condition of a thermal image forming apparatus for each TPH vendor information. The print condition includes at least one of gamma, sensitivity, or a predetermined parameter such as Ampli, Alpha, Ki, and so forth. The parameter "Ampli" is the temperature variation compensation constant due to printing several lines previously. The parameter "Ki" is the temperature compensation constant due to printing adjacent pixels. The parameter "Alpha" is the surrounding temperature compensation constant. The print condition storing portion 110 may be a form of a lookup table and thus may be embodied into a gamma lookup table or a sensitivity lookup table.

When the TPH ID identification portion 100 identifies a TPH vendor, the print condition search portion 120 searches the print condition storing portion 110 for a print condition corresponding to the identified TPH vendor.

The display portion 140 displays a result of the search of the print condition storing portion 110 by the print condition search portion 120 so that a user may view the result. When the print condition corresponding to the identified TPH vendor does not exist in the print condition storing portion 110, the user is notified of such fact, such as by a warning message.

The print condition setting portion 130 sets the searched print condition as a print condition for a thermal image forming apparatus. Also, the print condition setting portion 130 includes a manual setting portion 132. The manual setting portion 132 provides a user interface so that the user may change the print condition value to a desired value while viewing the print condition displayed on the display portion 140.

Figure 2:
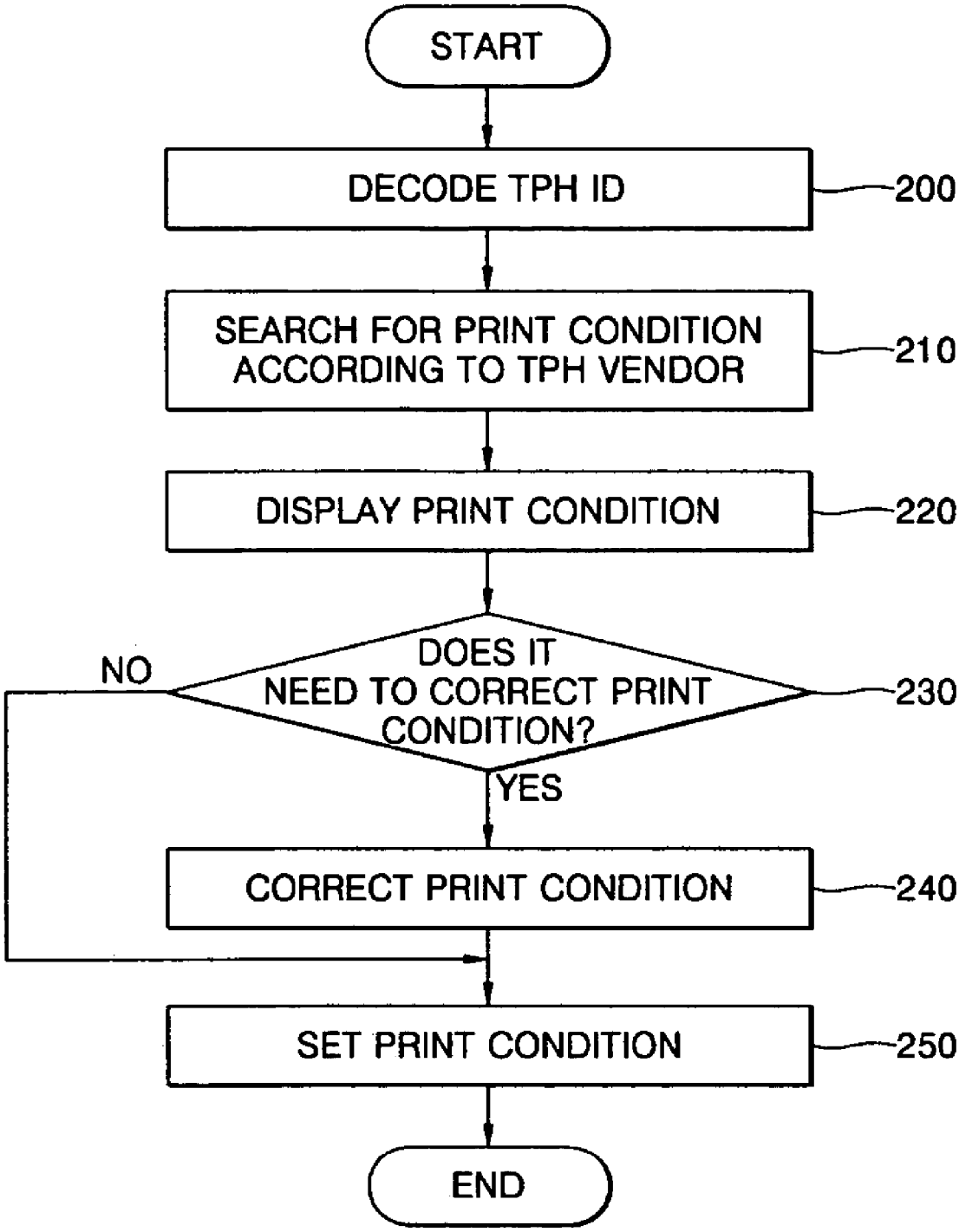
FIG. 2 is a flow chart illustrating a method of setting a print condition according to a TPH according to an exemplary embodiment of the present invention.

FIG. 2 is a flow chart illustrating a method of setting a print condition according to a TPH according to an exemplary embodiment of the present invention. Referring to FIGS. 1 and 2, the operation of the apparatus for setting a print condition according to a TPH and a method of setting a print condition according to a TPH according to an exemplary embodiment of the present invention are described below.

Figure 3:
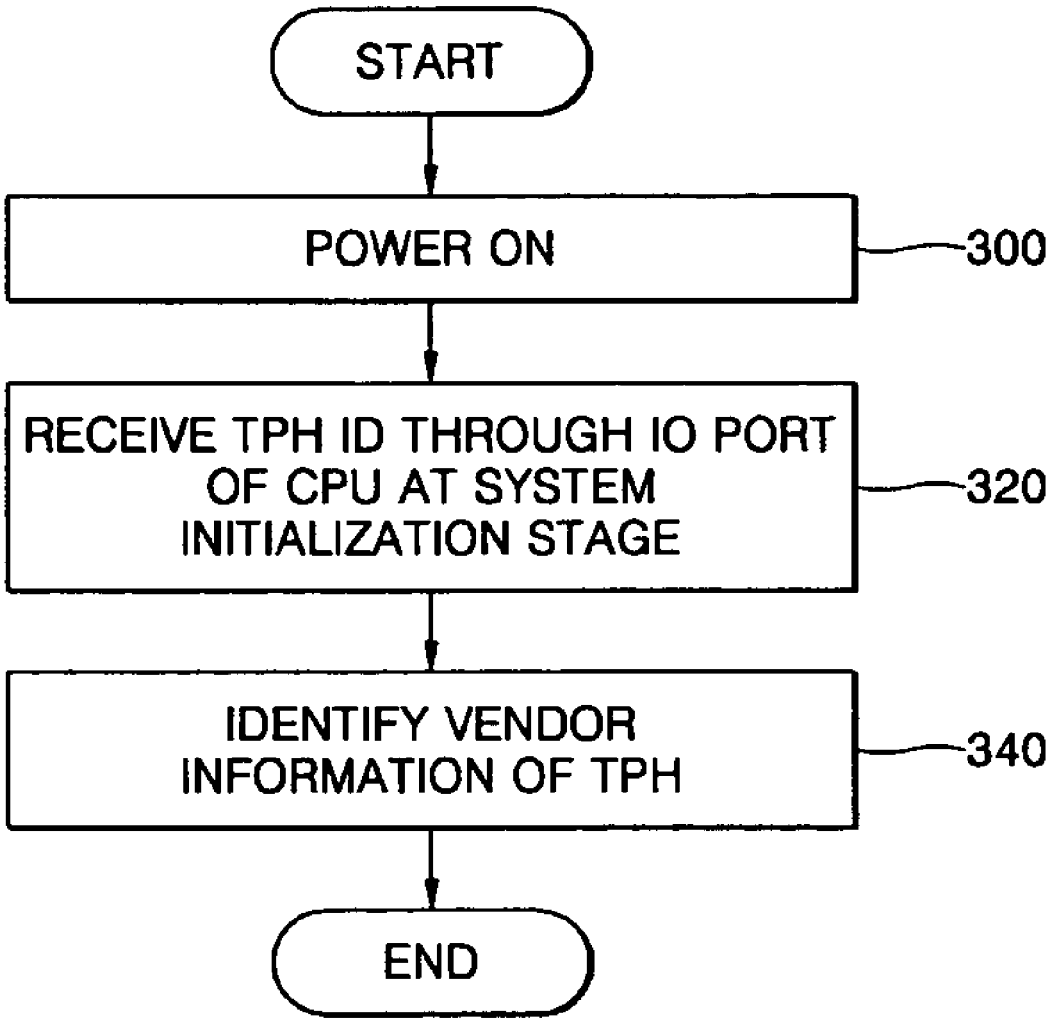
FIG. 3 is a flow chart illustrating in detail a step of identifying vendor information through a TPH ID according to an exemplary embodiment of the present invention.

First, the TPH ID identification portion 100 decodes a TPH identifier (ID) used for a thermal image forming apparatus so that TPH vendor information is obtained (Step 200). FIG. 3 is a flow chart illustrating in detail a step of identifying vendor information through a TPH ID. When system power is turned on (POWER ON, Step 300). The TPH ID is input through the 10 port of the CPU at the system initialization stage (Step 320). Then, vendor information of the TPH is obtained by decoding the TPH ID (Step 340).

When the TPH vendor information is identified, the print condition search portion 120 searches the print condition storing portion 110 for a print condition corresponding to the identified TPH vendor information (Step 210). Next, the display portion 140 displays a searched print condition value (Step 220). Then, a user checks whether a displayed print condition needs to be corrected (Step 230). When there is no need to correct, the print condition setting portion 130 sets the searched print condition as a print condition of the thermal image forming apparatus (Step 250).

When the user finds a need to correct the print condition displayed in Step 240, the user corrects the print condition through the manual setting portion 232 (Step 240). The corrected value is set as a print condition of the thermal image forming apparatus (Step 250).

Figure 4:
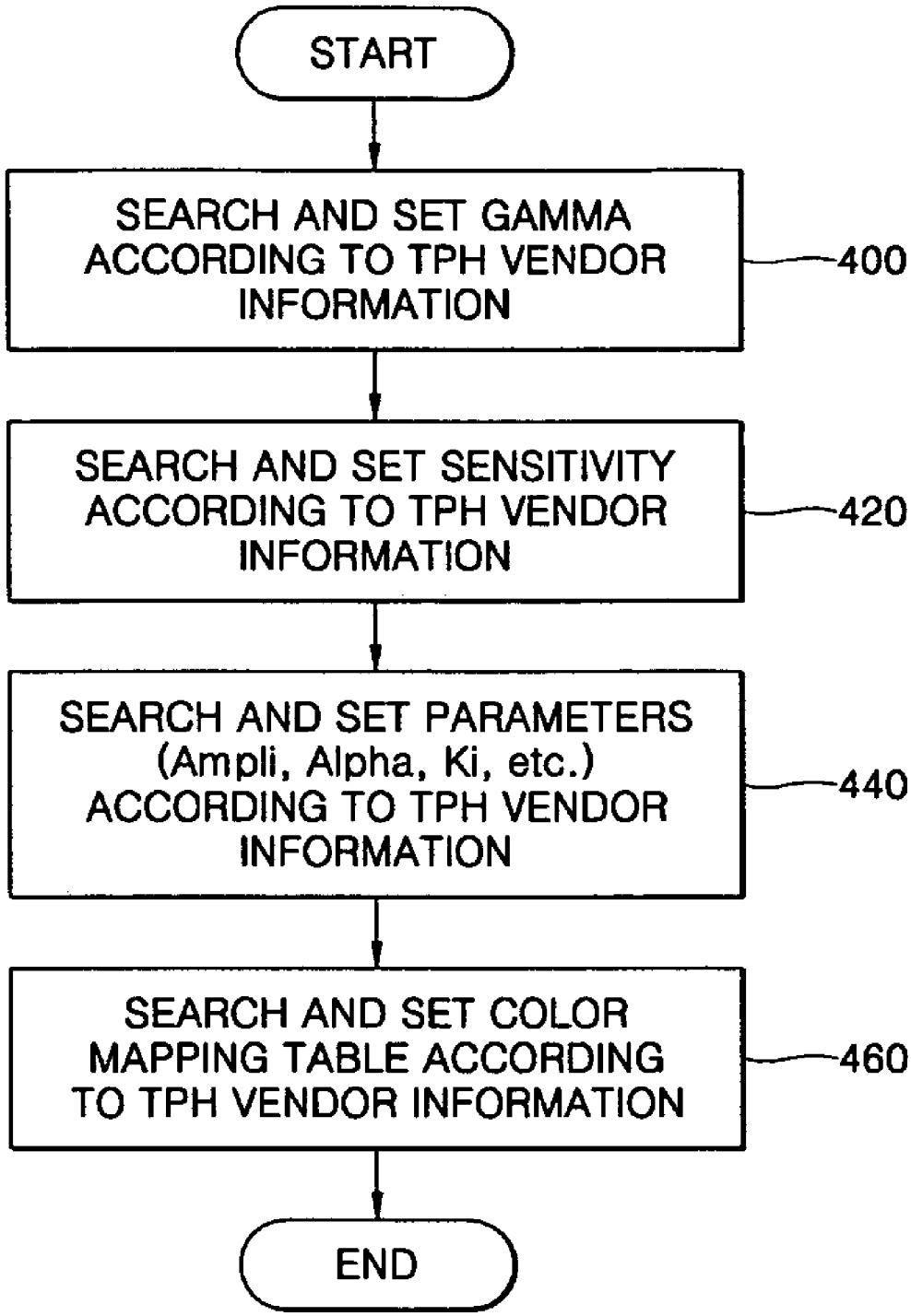
FIG. 4 is a flow chart illustrating in detail steps of searching and setting a print condition suitable for a vendor of the TPH according to an exemplary embodiment of the present invention.

FIG. 4 is a flow chart illustrating in detail the steps of searching and setting a print condition suitable for a vendor of the TPH. Referring to FIG. 4, gamma is first searched for and set according to the TPH vendor information (Step 400). Next, sensitivity is searched for and set (Step 420) and other parameters such as Ampli, Alpha, Ki, and so forth and a color mapping table are sequentially searched for and set (Steps 440 and 460).

The exemplary embodiments of the present invention may be used for a thermal history control (THC) of a thermal image forming apparatus. The THC is an algorithm for calculating energy to be output by the TPH with an input of image data to be printed and a current temperature of the TPH. To calculate the TPH output energy, the THC uses a gamma lookup table, a sensitivity lookup table, and a lookup table for other predetermined parameters such as Ampli, Alpa, Ki, and so forth These values are changed according to the property of the TPH vendor or media. When power is turned on (Power On), a main controller (not shown) is provided the gamma lookup table, the sensitivity lookup table, and predetermined parameters. After the vendor information of the TPH is identified, corresponding lookup table or parameters are selected and provided.

The invention may also be embodied as computer readable codes on a computer readable recording medium. The computer includes all types of apparatuses having an information processing function. The computer readable recording medium is any data storage device that stores data that is thereafter readable by a computer system. Examples of the computer readable recording medium include read-only memory (ROM), random-access memory (RAM), CD-ROMs, magnetic tapes, floppy disks, optical data storage devices, carrier waves and other suitable recording media.

As described above, according to the apparatus and method for setting a printing condition according to a TPH according to exemplary embodiments of the present invention, an optical print condition suitable for the property of the TPH of each of the TPH vendors may be set by identifying a TPH identifier (ID) to obtain the TPH vendor information and automatically setting a print condition varying according to the TPH vendor information, instead of being manually set.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An apparatus for setting a print condition according to a TPH (thermal printhead) of a thermal image forming apparatus, comprising:

a TPH ID (identifier) identification portion identifying TPH vendor information by decoding an ID of the TPH;

a print condition storing portion storing a predetermined print condition corresponding to a TPH vendor; and a print condition setting portion setting the print condition corresponding to the TPH vendor as a print condition corresponding to the identified TPH vendor information.

2. The apparatus as claimed in claim 1, wherein a print condition search portion searching the print condition storing portion for a print condition corresponding to the TPH vendor identified by the TPH ID identification portion, wherein the print condition setting portion sets a print condition searched by the print condition search portion as a print condition of the thermal image forming apparatus.

3. The apparatus as claimed in claim 2, wherein a display portion displaying a result of the search by the print condition search portion and, when the print condition with respect to the TPH vendor identified by the TPH ID identification portion does not exist displaying such a message.

4. The apparatus as claimed in claim 3, wherein the print condition setting portion further includes a manual setting portion for manually setting a print condition by changing the print condition displayed on the display portion.

5. The apparatus as claimed in claim 2, wherein the print condition storing portion is in a form of a lookup table.

6. The apparatus as claimed in claim 2, wherein the TPH vendor information includes the TPH vendor information and a TPH model information.

7. The apparatus as claimed in claim 1, wherein the TPH print condition includes at least one of gamma, sensitivity, and a predetermined parameter of Ampli, Alpha, and Ki.

8. The apparatus as claimed in claim 1, wherein the TPH ID is manually entered.

9. A method for setting a print condition according to a TPH (thermal printhead) of a thermal image forming apparatus, the method comprising the steps of identifying TPH vendor information by decoding an identifier (ID) of the TPH; and setting a print condition corresponding to an identified TPH vendor information as the print condition of the thermal image forming apparatus.

10. The method as claimed in claim 9, wherein the TPH vendor information includes the TPH vendor information and a TPH model information.

11. The method as claimed in claim 9, wherein the TPH print condition includes at least one of gamma, sensitivity, and a predetermined parameter of Ampli, Alpha, and Ki.

12. The method as claimed in claim 9, wherein the setting the print condition corresponding to the identified TPH vendor information as the print condition of the thermal image forming apparatus step further comprises:

searching the print condition storing portion, where a predetermined print condition according to the TPH vendor information is stored, for a print condition corresponding to the identified TPH vendor information.

13. The method as claimed in claim 12, further comprising setting a searched print condition as the print condition of the thermal image forming apparatus.

14. The method as claimed in claim 13, further comprising displaying the searched print condition when the searched print condition exists.

15. The method as claimed in claim 14, further comprising displaying a message stating the searched print condition does not exist when the searched print condition does not exist.

16. The method as claimed in claim 13, further comprising manually changing the displayed print condition to change the stored print condition.

17. The method as claimed in claim 9, further comprising manually entering the TPH identifier.

* * * * *